US006623000B2

(12) United States Patent
Hall

(10) Patent No.: US 6,623,000 B2
(45) **Date of Patent: *Sep. 23, 2003**

(54) APPARATUS AND METHOD FOR SEPARATING SHEET MATERIAL BY MEANS OF A RECIPROCATING DISK SEPARATOR

(75) Inventor: David F. Hall, Plattsburgh, NY (US)

(73) Assignee: Prim Hall Enterprises Inc., Plattsburgh, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/882,002

(22) Filed: Jun. 15, 2001

(65) Prior Publication Data

US 2003/0001328 A1 Jan. 2, 2003

(51) Int. Cl.[7] ..... B65H 5/08

(52) U.S. Cl. ..... 271/11; 271/10.09; 271/10.11; 271/100; 271/106

(58) Field of Search ..... 271/16, 10.09, 271/10.1, 10.11, 21, 23, 100, 106, 37, 113, 114, 115, 275, 277, 11; 221/223

(56) References Cited

U.S. PATENT DOCUMENTS 678,754 A 7/1901 McNutt
999,936 A 8/1911 Wines
1,030,891 A 7/1912 Kast
1,709,857 A 4/1929 Kleineberg
1,794,198 A 2/1931 Murray (List continued on next page.)

*Primary Examiner*—David H. Bollinger
(74) *Attorney, Agent, or Firm*—Heslin Rothenberg Farley & Mesiti P.C.; John Pietrangelo

(57) ABSTRACT

A feeding and conveying system for feeding and conveying sheet material for printing, collating, or binding the sheet material, among other processes. The feeding and conveying system includes at least one feeder having a magazine containing a plurality of articles of sheet material, for example, signatures, a rotatable disk for separating the sheet material from the magazine, and a feed drum for transferring the sheet material from the magazine to a conveyor. The rotatable disk, having at least one separating blade, is reciprocally rotated to separate the sheet material from the magazine. The separation of the sheet material from the magazine may be aided by applying a source of vacuum to the sheet material, for example, by means of suckers. The feed drum may include one or more grasping devices for grasping and retaining the sheet material, for example, one or more grippers. The rotation of the separator disk may be controlled by a programmable controller. The feeding and conveying system provides for increased throughput while minimizing or eliminating misalignment of the sheet material during handling.

14 Claims, 5 Drawing Sheets

U.S. PATENT DOCUMENTS 1,907,713 A * 5/1933 Benson ..... 221/223
2,020,321 A 11/1935 Kleineberg
2,159,456 A 5/1939 Spiess
2,161,866 A 6/1939 Huckins
2,413,358 A 12/1946 Kleineberg
2,423,563 A 7/1947 Morris
2,564,417 A 8/1951 Baker et al.
2,621,039 A 12/1952 Kleineberg et al.
2,799,497 A 7/1957 Novick
3,045,867 A 7/1962 Flynn
3,100,110 A 8/1963 Winkler et al.
3,544,097 A 12/1970 Linden
3,565,422 A 2/1971 McCain et al.
3,586,316 A 6/1971 Ehlscheid et al.
3,650,525 A 3/1972 Hageman et al.
3,702,187 A 11/1972 Hageman et al.
3,762,701 A 10/1973 Hannon et al.
3,768,804 A 10/1973 Swanson
RE28,048 E 6/1974 Hageman
3,825,247 A 7/1974 Fernandez-Rana et al.
3,841,626 A 10/1974 Weisgerber
3,913,478 A 10/1975 Terzuolo et al.
3,944,215 A 3/1976 Beck
3,960,079 A 6/1976 Capetti
4,013,283 A 3/1977 Tress et al.
4,052,055 A 10/1977 Jiruse et al.
4,395,033 A 7/1983 Janssen et al.
4,531,724 A 7/1985 Lukas et al.
4,583,723 A 4/1986 Ozawa
4,625,952 A 12/1986 Schniter et al.
4,637,600 A 1/1987 Bartimes et al.
4,705,386 A * 11/1987 Ogita et al. ..... 355/4
4,768,770 A 9/1988 Pessina et al.
4,889,331 A 12/1989 Sardella
4,909,150 A 3/1990 Leyendecker et al.
4,921,237 A 5/1990 Nubson et al.
4,928,950 A 5/1990 Sardella
5,005,815 A 4/1991 Auksi
5,137,267 A 8/1992 Wirz et al.
5,330,169 A 7/1994 Hawkes
5,535,998 A 7/1996 Geffert et al.
5,664,786 A * 9/1997 Buschbaus et al. ..... 271/10.09
5,749,570 A 5/1998 Iwata et al.
5,782,468 A 7/1998 Wu et al.
6,015,145 A 1/2000 Hartel
6,113,092 A * 9/2000 Greive et al. ..... 271/115
6,193,229 B1 2/2001 Hall et al.

* cited by examiner fig.

APPARATUS AND METHOD FOR SEPARATING SHEET MATERIAL BY MEANS OF A RECIPROCATING DISK SEPARATOR

TECHNICAL FIELD

The present invention relates to sheet material handling systems, and more particularly to devices for separating signatures during the collating and binding of, for example, books.

BACKGROUND OF THE INVENTION

The binding and printing industries often rely on high-speed sheet material handling systems for printing, collating, and binding and otherwise handling sheet material, for example, sheets of paper. This sheet material, for example, individual sheets, newspapers, magazines, inserts and "onserts" (that is, referring to sheet material used when collating newspapers), books, brochures, and the like, is typically, stacked in containers or "magazines" or "hoppers" and withdrawn from the magazines or hoppers for further processing. One particular sheet material that is handled in the binding and printing industry is what is known in the art as "signatures". Signatures are sheets of paper, that may have a spine fold, that contain at least two pages of text. Typically signatures contain 4 or more pages of text, for example, 30 or more pages of text. In the manufacture of books it is common to assemble the book on a collecting conveyor by sequentially withdrawing signatures from magazines, or hoppers, containing stacks of signatures. In producing a book, typically, a plurality of serially-arranged magazines, separating devices, and feeders are employed for gathering the printed sheets of, for example, signatures.

Typically, the separating devices separate and withdraw the sheet material from the magazines and feed the sheet material to a rotating drum. The rotating drum then feeds the sheet material to a conveyor which collects and transfers the separated printed sheets for collation, binding, or other operations. The separation of the sheet material from the stacked sheet material can be effected by a rotating disk separator aided by a suction device, known in the art as a "sucker". One typical disk-type separator is disclosed in U.S. Pat. No. 6,193,229 B1, the disclosure of which is incorporated by reference herein in its entirety. The disk separator separates and feeds the sheet material to a rotating drum which accepts and retains the sheet material and conveys it to the conveyor. The disk separator, typically with the aid of the suction device, deflects the edge of the lower-most article of sheet material in the magazine stack. When the sheets to be withdrawn from the magazine are in the form of signatures, the deflected edge is typically the spine fold portion of the sheet. The rotating drum positioned below the disk separator typically includes some means of retaining the sheet material as it rotates, for example, devices known in the art as "grippers". The conveyor which receives the sheet material is typically a horizontal conveyor. This horizontal conveyor may also receive sheet material from other, typically serially-positioned, feeding drums. A common drive mechanism typically drives the separator, suction device, feed drum, and the conveyer.

The throughput of such systems is dependent upon on how closely together the sheet material is spaced, and on how fast the sheet material is moved. Accordingly, the throughput of such systems may be optimized by spacing the sheet material as closely together as possible and by maximizing the speed of operation of each of the components. For example, the rotational speed of the separator disk is of fundamental importance to performance of such sheet material handling systems. The faster the separator disk can rotate from the position where it enters the stack of sheet material to the position where the sheet material is separated, the better the system throughput.

Another important considering in the operation of disk-type separators is the alignment of the sheet material with separator disk. Since the disk separators of such devices rotate at high speed and typically "bite into" the stack of sheet material in the magazine, misalignment of the sheet material and the disk can cause misfeeds, jamming, or even damage to the equipment. According to the prior art methods the disk separators rotate in one direction and thus repeatedly impact the stack of sheet material in essentially one direction. This repeated engagement of the disk with the stack can cause the stack or individual articles within the stack to migrate or move in the direction of rotation of the disk. This migration of the sheet material can result in the misalignment and its potential consequences mentioned above. This disadvantage of the prior art is overcome by one aspect of the present invention.

Commonly-assigned U.S. Pat. No. 6,193,229 B1 discloses a method and apparatus for improving the throughput of a sheet material feeding system having a disk-type separator. This improvement is provided by using a servo-motor-driven disk separator to vary the speed of rotation of the disk separator. The speed of the servo-motor is monitored and controlled by means of a servo-control system, that is, an automated feed-back control loop. Though the method and apparatus for feeding disclosed in U.S. Pat. No. 6,193,229 B1 provides an effective means for controlling and feeding sheet material, the present invention provides improvements which further enhance the effectiveness of disk-type sheet-material feeders.

SUMMARY OF THE INVENTION

The present invention provides methods and apparatus which address many of the limitations of prior art methods and apparatus. One aspect of the present invention is a feeder for delivering at least one article of sheet material to a conveyer. The feeder includes: a rotatable separator disk for separating stacked articles of sheet material; a servomotor mechanically coupled to the separator disk adapted to impart reciprocating rotation to the separator disk; and a rotatable feed drum oriented to receive the article separated by the separator disk and to transfer the article of sheet material to the conveyor. The articles of sheet material may be sheets of paper, signatures, newsprint, magazines, inserts, onserts, flyers, or brochures. It will be understood by those familiar with the art that the conveyor may be a collator or a gatherer. In one aspect of the invention, the servomotor reverses the rotation of the separator disk after the disk enters the stacked articles of sheet material. The feeder may further include a servo-control system coupled with the servomotor. The servomotor is typically adapted to rotate the disk in a first direction and rotate the disk in a second direction, opposite the first direction. The servo-control system is typically programmable.

One advantage of the present invention compared to the prior art is that the back and forth motion of the separator tends to prevent movement or migration of the sheet material in the magazine, which can characterize prior art systems having non-reciprocating motion of the disk. For example, the return stroke of the disk helps to compensate for any deflection of the stack of sheet material that occurs due to the separating stroke. Thus, according to one aspect of the present invention, misalignment of the sheet material with the separator disk or drum, which can cause misfeeds or otherwise interfere with proper operation of the feed system, is minimized or eliminated.

Another aspect of the present invention is a method for separating articles of sheet material. The method includes: providing a separator disk for separating at least one article of sheet material from a stack of sheet material; providing a servomotor for rotating the separator disk; and reciprocatingly rotating the separator disk to separate the articles of sheet material from the stack of sheet material. Reciprocatingly rotating is typically practiced by a) rotating the separator disk in a first direction and b) rotating the separator disk in a second direction, opposite the first direction. Steps a) and b) are typically repeated, for example, b) may be practiced immediately after a). Also, a) is typically practiced by accelerating the disk to first rotational speed and b) is practiced by accelerating the disk to second rotational speed; the first rotational speed may be about equal to the second rotational speed.

Another aspect of the present invention is a method for separating articles of sheet material and feeding the articles of sheet material to a conveyor. The method includes: providing a magazine containing at least one article of sheet material; providing a separator disk for separating at least one article of sheet material in the magazine; providing a feed drum oriented to receive the at least one separated article of sheet material and transfer the at least one separated article to the conveyor; reciprocatingly rotating the separator disk to separate the at least one article of sheet material from the magazine; transferring the at least one separated article of sheet material from the magazine to the feed drum; and transferring the separated at least one article of sheet material from the feed drum to the conveyor. This method may further include deflecting the edge of the article of sheet material prior to transferring the separated article from the magazine to the feed drum, for example, by applying a source of vacuum to the article of sheet material.

A still further aspect of the present invention is a system for separating articles of sheet material. The system includes: a rotatable separator disk for separating stacked articles of sheet material; a motor operatively connected to the separator disk for rotating the separator disk; and a programmable controller for controlling the operation of the motor. The programmable controller is typically programmed to operate the motor whereby the separator disk is reciprocatingly rotated, that is, the separator disk is rotated in a first direction and then rotated in a second direction, opposite the first direction, for example, immediately after rotating the disk in the first direction.

An even further aspect of the present invention is a feeder for delivering articles of sheet material to a conveyer. The feeder includes: a rotatable separator disk for separating stacked articles of sheet material; a motor operatively connected to the separator disk for rotating the separator disk; a programmable control system for controlling the operation of the motor; and a rotatable feed drum oriented to receive the articles of sheet material separated by the separator disk and transfer the articles of sheet material to the conveyor. The programmable control system is typically programmed to control at least the speed of rotation of the motor. In one aspect of the invention, the programmable control system is programmed to operate the motor whereby the separator disk is reciprocatingly rotated.

A still further aspect of the present invention is a method for separating articles of sheet material and feeding the articles of sheet material to a conveyor. The method includes: providing a magazine containing articles of sheet material; providing a separator disk driven by a motor for separating at least one article of sheet material in the magazine; providing a programmable controller system for controlling the rotation of the separator disk; providing a feed drum oriented to receive at least one separated article of sheet material and transfer the separated article of sheet material to the conveyor; rotating the separator disk in response to the programmable controller to separate at least one article of sheet material from the magazine; transferring the at least one separated article of sheet material from the magazine to the feed drum; and transferring the at least one separated article of sheet material from the feed drum to the conveyor. This method may further include deflecting an edge of the article of sheet material prior to transferring the separated article of sheet material from the magazine to the feed drum. Transferring the separated article of sheet material from the magazine to the feed drum is typically practiced by grasping the article with grippers mounted on the feed drum. Again, in one aspect of the invention, rotating the separator disk in response to the programmable controller is practiced by reciprocatingly rotating the separator disk. For example, in one aspect of the invention, reciprocatingly rotating the separator disk is practiced whereby misalignment of the articles of sheet material in the magazine is minimized.

These and other embodiments and aspects of the present invention will become more apparent upon review of the attached drawings, description below, and attached claims.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following detailed descriptions of the preferred embodiments and the accompanying drawings in which:

DETAILED DESCRIPTION OF THE PREFERRED EMBODIMENTS

Figure 1:
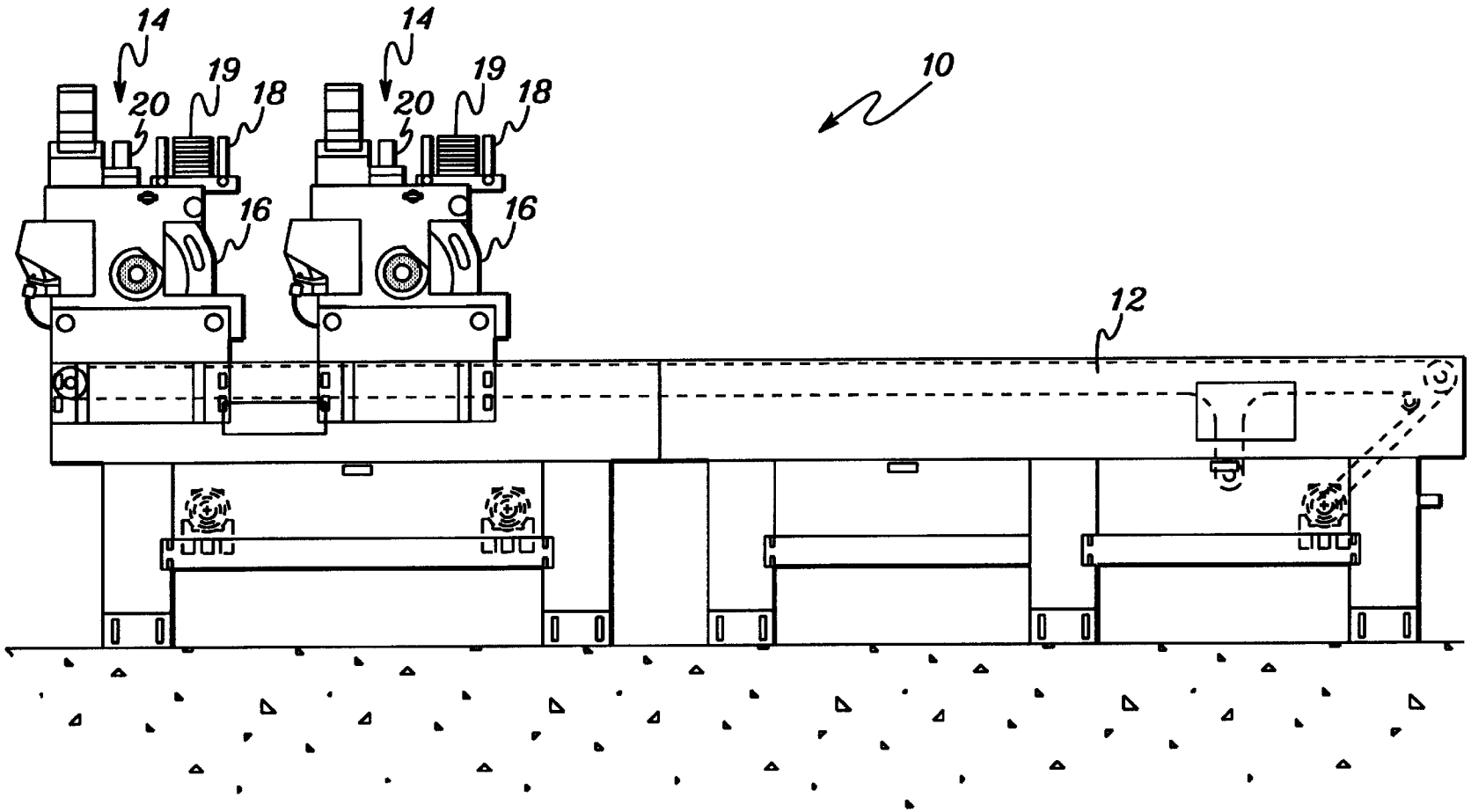
FIG. 1 is a side view of a feeding and conveying system for sheet material which incorporates one aspect of the present invention.

FIG. 1 illustrates a feeding and conveying system, generally designated with the reference numeral 10, for feeding and conveying sheet material that employs one aspect of the present invention. The sheet material that can be fed and conveyed includes, but is not limited to, individual sheets, signatures, newspapers, magazines, books, booklets, brochures, inserts, or onserts, among other types of sheet material. Feeding and conveyer system 10 typically includes a conveyer 12, and at least one, typically more than one, sheet material feeder 14. Each feeder 14 includes a rotatable feed drum 16, a magazine 18 of stacked sheet material 19, and a separator disk 22 (see FIG. 2) driven by a servomotor 20. Feeder 14 separates sheet material 19 from the magazine 18 and feeds it via drum 16 to conveyor 12. Conveyor 12 may be collating conveyor, that is, a collator, or a gathering conveyor, that is, a gatherer, among other types of conveyors. For example, in one aspect of the invention, conveyor 12 receives onserts from feeder 14 which are placed on top of articles of sheet material, for example, other onserts, that are already on conveyor 12.

The conveyer 12 is positioned with respect to the feed drums 16 for receiving sheet material from feed drum 16. Feed drum 16 rotates and delivers sheet material 19, typically one at a time, to conveyer 12. Conveyer 12, in accordance with one aspect of the invention, functions to gather, collate, or otherwise handle sheet material 19. For example, feeding and conveying system 10 shown in FIG. 1 includes multiple feeders 14 and is configured to enable conveyer 12 to gather and collate sheet material for a binding machine, though the system shown in FIG. 1 may be used to convey sheet material to other types of machines.

Figure 2:
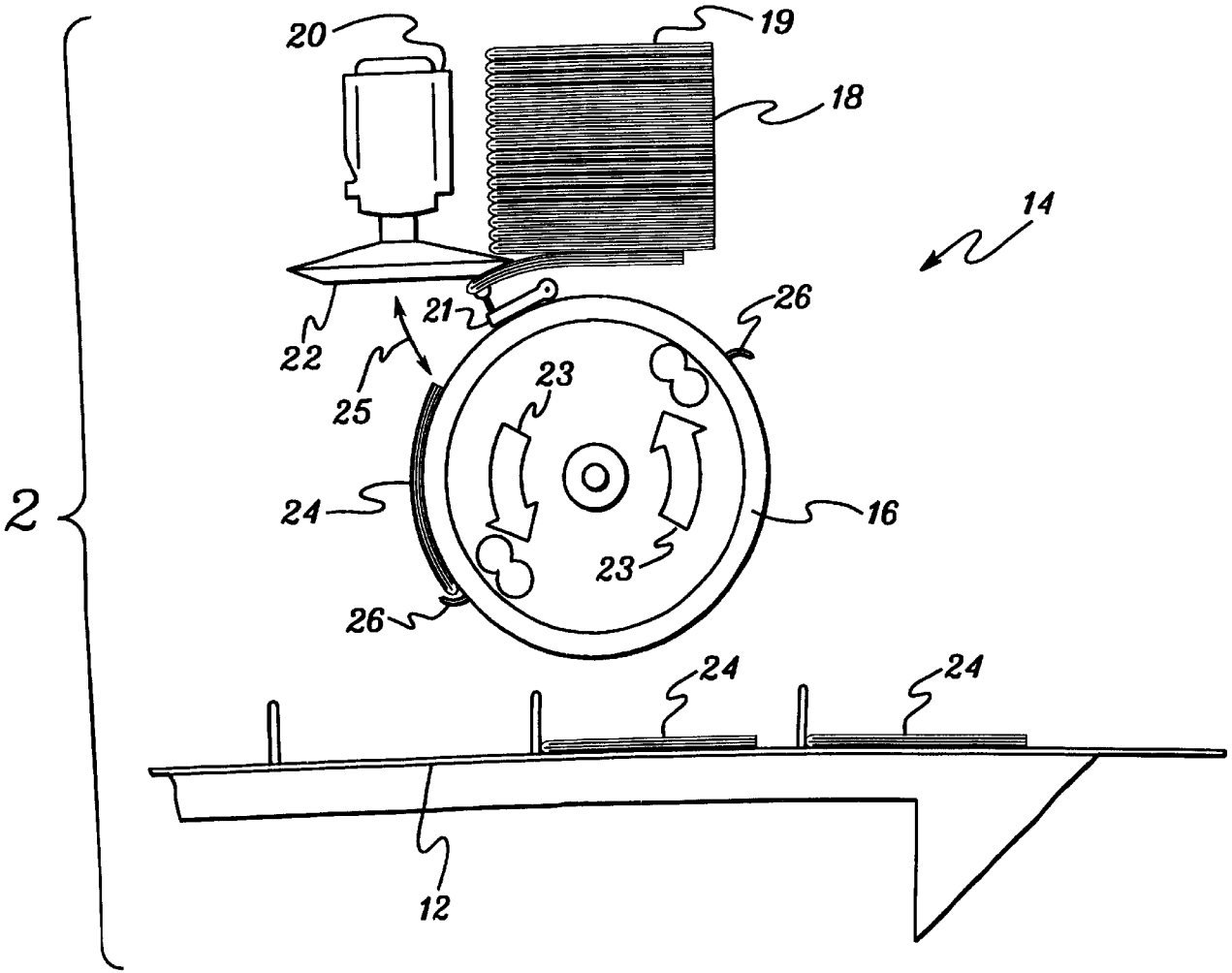
FIG. 2 is a side view of the sheet material feeder shown in FIG. 1 in accordance with one aspect of the present invention.

FIG. 2 illustrates a detailed view of the components that comprise sheet material feeder 14 which feeds conveyor 12. Conveyor 12 in FIG. 2 is a collating-type of conveyor, though other types of conveyors may be used. As noted above, feeder 14 includes a rotatable feed drum 16, a magazine 18 of stacked sheet material 19, and a separator disk 22 driven by a servomotor 20. As shown in FIG. 2, feeder 14 typically also includes means for deflecting the edge of an article of sheet material 19 from the magazine 18. One means for deflecting the edge of an article of sheet material 19 from the magazine 18 may be means for selectively applying a source of vacuum to the lower-most article of sheet material 19 in magazine 18. In the aspect shown in FIG. 2, a device 21 known in the art as a "sucker" is used for selectively applying a source of vacuum. Sucker or suction device 21 is operatively connected to a source of vacuum (not shown) and is adapted to selectively apply the vacuum to the sheet material 19, for example, as a synchronized function of the relative rotation of drum 16. Suction device 21 is also typically pivotally mounted for rotation as indicated by double arrow 25, that is, suction device 21 may be raised and lowered to engage and deflect sheet material 19. Suction device 21 typically applies a vacuum to the surface of an article of sheet material 19 that varies from about 18 inches of Hg (that is, inches of mercury) to about 25 inches of Hg.

Separator disk 22 is mechanically coupled to servomotor 20. Servomotor 20 typically rotates disk 22 at maximum speeds of between about 900 rpm and about 1200 rpm. Separator disk 22 is positioned adjacent to magazine 18 whereby at least a portion of the surface of disk 22 engages and separates at least one article of sheet material 19, typically only one article 19 at a time. After an article of sheet material 19 is engaged and deflected by suction device 21, disk 22 engages and deflects article of sheet material 19 whereby article 19 can be engaged and retained by drum 16. Typically, only an edge of an article of sheet material 19 is deflected by suction device 21 and disk 22 and each article 19 is drawn out of the magazine by the rotation of drum 16. According to one aspect of the present invention, the rotation of servomotor 20 and thus separator disk 22 is controlled whereby disk 22 is reciprocatingly rotated, that is, disk 22 is rotated in a first direction and then in a second direction, opposite the first direction, and preferably repeatedly. Each repeated rotation in one direction and then rotation in the second, opposite direction comprises a machine cycle for servomotor 20 and disk and typically undergoes between about 250 and about 350 machine cycles per minute. This reciprocal rotation of disk 22 will be discussed further with respect to FIG. 5.

After sheet material 19 is engaged by and deflected by suction device 21 and separator disk 22 engages and further deflects and separates an article of sheet material 19, the article of sheet material 19 is positioned to be captured by feed drum 16. The separated article of sheet material on drum 19 is identified by reference number 24. In the view shown in FIG. 2, feed drum 16 rotates in a counter-clockwise direction as indicated by arrows 23. Typically, feed drum 16 includes some means for grasping and capturing article of sheet material 24 from magazine 18 and transferring it to conveyor 12. One means of grasping, capturing, and transferring sheet material 24 is by means of hinged linkages 26 that are selectively opened and closed to grasp and release an article of sheet material 24. Linkages 26 are known in the art as "grippers". Drum 16 may have one or more grippers, and typically two or more grippers evenly spaced about the periphery of drum 16. For example, in one aspect of the present invention three grippers 26 are used. Grippers 26 retain the separated sheet material 24 and transfer it with the rotation of drum 16 to conveyor 12. When the sheet material 24 is in position over conveyor 12, gripper 26 opens allowing sheet material 24 to fall, typically, simply under the force of gravity, upon conveyor 12. The position of grippers 26, that is, either opened or closed, is typically controlled and synchronized with the relative rotation of drum 16 and the operation of suckers 21 to ensure the uninterrupted movement of articles of sheet material 24 from magazine 28 to drum 16 to conveyor 12.

Figure 3:
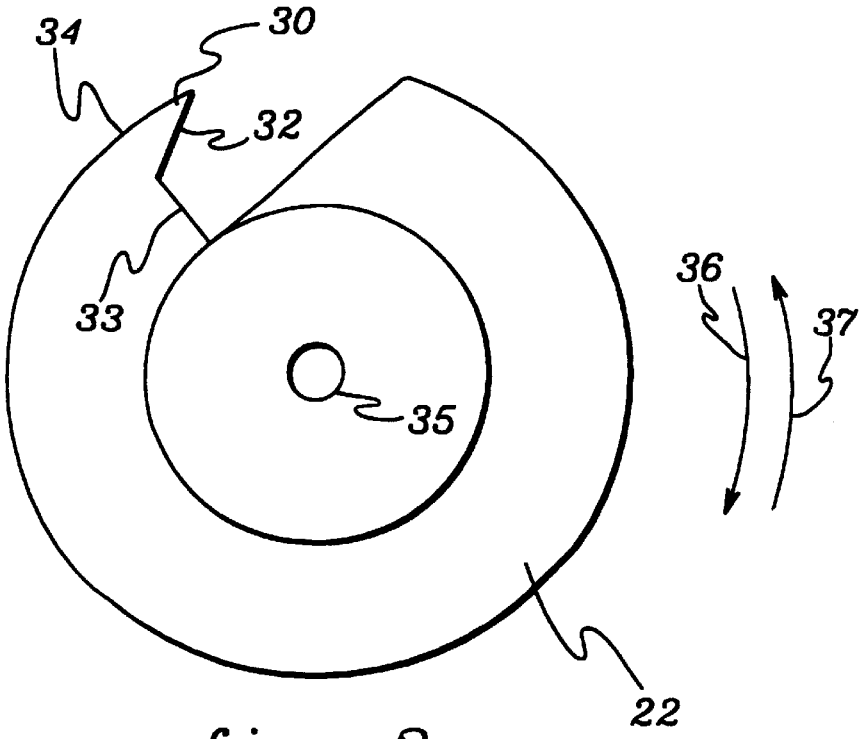
FIG. 3 is a top view of a separator disk that can be used with one aspect of the present invention.

FIG. 3 illustrates a top view of a separator disk 22 having a single protrusion or blade 30 that can be used to effect the present invention. Blade 30 has a leading edge 32 and a trailing edge 34. Disk 22 also includes a recess 33 and a axial hole 35 for mechanically coupling disk 22 to servomotor 20. According to one aspect of the present invention, separator disk 22 is reciprocally rotated by servomotor 20 (see FIG. 2) as indicated by arrows 36 and 37. During operation, after the edge of the sheet material 19 is deflected by suction device 21 (see FIG. 2), the rotation of disk 22 in the direction of arrow 36 causes leading edge 32 of blade 30 to contact stacked sheet material 18 whereby the edge of the lower-most sheet material 24 enters recess 33. Further rotation of separator disk 22 causes blade 30 to "bite" into stacked sheet material 18, separating sheet material 24 from the stacked sheet material 18. After separation of sheet material 24 from the stacked sheet material 18 is complete, trailing edge 34 of blade 30 exits stacked sheet material 18.

According to one aspect of the present invention, after blade 30 separates an article of sheet material 24 from the stacked sheet material 18, for example, after trailing edge 34 passes through stacked sheet material 18, the rotation of disk 22 is slowed, stopped (typically momentarily) and then reversed by servomotor 20 whereby blade 30 passes through the stacked sheet material 18 in the direction of arrow 37. That is, the direction of rotation of disk 22 is reversed. After blade 30 passes through stacked sheet material 18 in the direction arrow 37, for example, after leading edge 32 passes through stacked sheet material 18 in the direction of arrow 37, the rotation of blade 22 is again slowed and reversed whereby the next article of sheet material is engaged and deflected by blade 30. According to one aspect of the present invention, this cycle of rotating disk 22 in the direction of arrow 36 and then in the direction of arrow 37, that is, in reciprocally rotating disk 22, is essentially continuously repeated as long as necessary, for example, at a rate of between about 250 and about 350 machine cycles per minute. In addition to effectively separating sheet material, this reciprocal rotation of disk 22, among other things, minimizes the misalignment, or mis-registration, of the stacked sheet material that can occur when a separator disk, such as disk 22, is continuously rotated in a single direction. Repeatedly engaging the stack of sheet material 18 in the same direction, as would happen when disk 22 is only rotated in one direction, that is, not reciprocated, can physically move or shift the stack 18 from its desired position in the feeder 14, causing mis-alignment of, among other things, the stack 18 and the disk 22 and the stack 18 and the suction device 21. This mis-alignment is minimized or eliminated entirely when the rotation of disk 22 is reciprocated according to the present invention.

Figure 4:
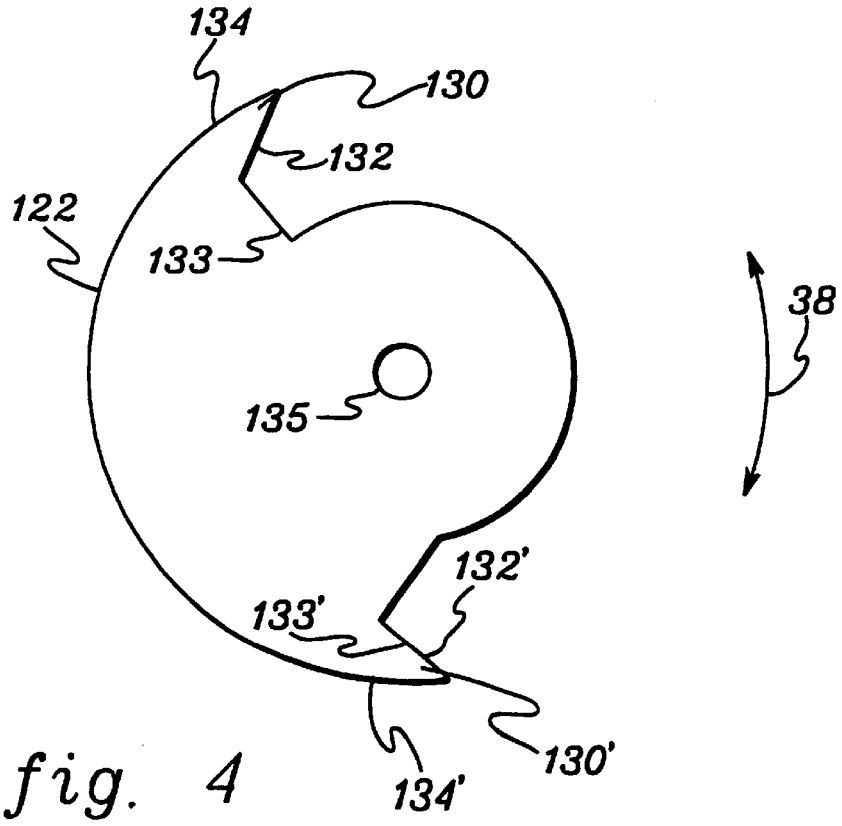
FIG. 4 is a top view of a separator disk that can be used with another aspect of the present invention.

FIG. 4 illustrates another separator disk 122 that can be used for the present invention, which is a variation of separator disk 22 shown in FIG. 3. Separator disk 122 has two opposing protrusions or blades 130 and 130'. Blades 130, 130' oppose each other to enable separator disk 122 to selectively rotate in either of the two directions indicated by double arrow 38. Blades 130, 130' have leading edges 132, 132' and trailing edges 134, 134', respectively. Disk 122 includes two recesses 133, 133' and an axial hole 135. Blades 130, 130'; leading edges 132, 132'; trailing edges 134, 134'; recesses 133, 133'; and axial hole 135 all operate and function in the same fashion as the corresponding features described with respect to FIG. 3. Rotation in the two directions indicated by arrow 38 is desirable depending on how articles of sheet material 18 are stacked in feeder 14. For example, having two reciprocating blades 130, 130' on disk 122 doubles the throughput of feeder 14 compared to the single-bladed disk 22 shown in FIG. 3. The reciprocal motion of disk 122 also provides the same magazine sheet material alignment benefits discussed with respect to the reciprocation of disk 22 above. The double-bladed disk 122 shown in FIG. 4 can also be used in "gatefold" applications, that is, wherein the fold edge of the sheet material (for example, signature) is located on the feeder side of hopper 18. In gatefold applications, the operation of the feeder 14 is controlled so that the edge 130' first engages the stack of sheet material in a counter-clock-wise direction as viewed in FIG. 4. According to one aspect of the present invention, for example, having a programmable system 50, this reversal of disk 122 operation can be effected by a simple electronic switch, for example, either a manual or an automated switch, for instance, a switch that changes the direction of rotation of servomotor 20.

Figure 5:
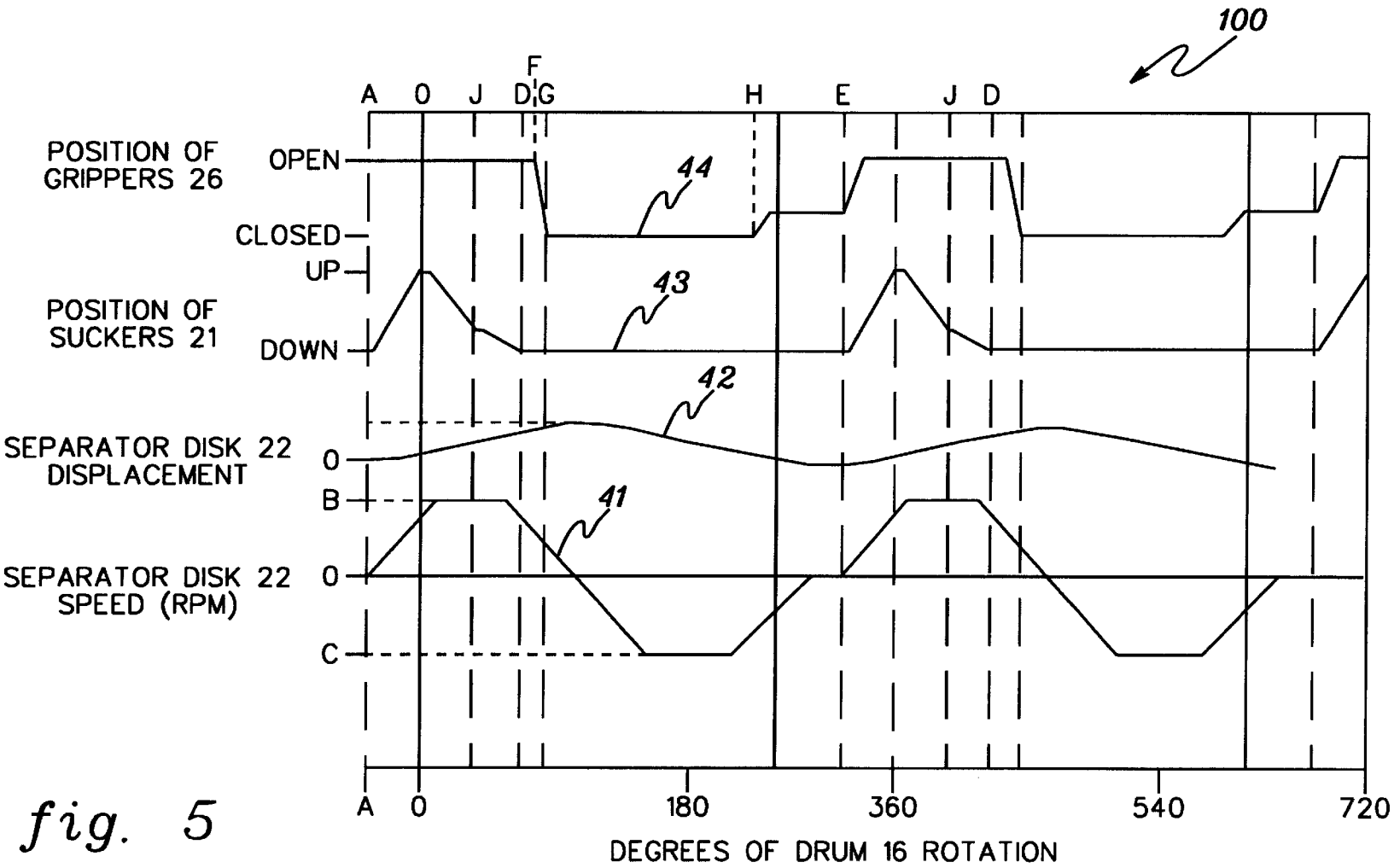
FIG. 5 is graph of various feed system parameters as a function of degree of drum rotation according to one aspect of the present invention.

FIG. 5 illustrates a graph 100 showing profiles of various parameters of the feeding and conveying system 10 of one aspect of the present invention as a function of the rotation of drum 16. The profiles that appear in FIG. 5 were computed for a feeder and conveyor system having the following parameters:

| | |
|---|---|
| Drum 16 diameter: | 17 inches |
| Corresponding circumference of drum 16: | 53.4 inches |

-continued

| | |
|---|---|
| No. of grippers 26: | 3 |
| Corresponding length of drum arc between grippers: | 120 degrees or 17.8 inches |
| Maximum length of signature: | 13.5 inches. |

Curve 41 is a typical representation of a rotational speed profile of separator disk 22 as a function of the rotation of the drum 16 according to one aspect of the present invention. As shown on the left side of graph 100, disk 22 is approximately stationary at a time when the position of drum 16 is at a point A, for example, at approximately −13 degrees from a reference position of drum 16. This position of disk 22 is sometimes referred to as the "disk home position". As controlled by servomotor 20, in response to servo-control system 50 (see FIG. 6), disk 22 accelerates in a generally uniform fashion (for example, at a relatively constant angular acceleration) to a maximum speed B, for example, a speed of from about 600 rpm to about 900 rpm, depending upon the size and configuration of the sheet material being handled. The speed of disk 22 is typically maintained for a predetermined time interval, for example, speed B may be maintained for time interval corresponding to about 45 to about 55 degrees of rotation of drum 16. As shown by curve 41, the speed of disk 22 then decelerates in a generally uniform fashion (again, for example, at a relatively constant angular acceleration) whereby disk 22 comes to a momentary stop and then reverses direction and accelerates to a speed C rpm in the opposite direction, for example, a speed of from about 600 rpm to about 900 rpm. The magnitude of speed C may be the same as the magnitude of speed B. Again, the speed C is typically maintained for a predetermined time interval, which may be the same interval at which the speed B is maintained, for example, speed C may be maintained for time interval corresponding to about 45 to about 55 degrees of rotation of drum 16. The speed of disk 22 then decelerates in a generally uniform fashion (again, for example, at a relatively constant angular acceleration) and is stopped at a time corresponding to the position of drum 16 of from about 300 to about 310 degrees. Disk 22 is then held stationary for a time period corresponding to about 20 to about 30 degrees of the rotation of drum 16. Disk 22 then accelerates again and the above disk speed profile is repeated. Curve 42 represents the corresponding profile of the displacement of disk 22 as a function of the rotation of drum 16.

The position of suckers 31 and grippers 26 are also illustrated in graph 100. Curve 43 represents a typical profile of position of suckers 31, for example, "up" or "down", as a function of the rotation of drum 16. As shown by curve 43 in FIG. 5, at a time corresponding to when drum 16 is oriented in line with the reference, that is, at the zero degree position, suckers 21 are "up", that is, rotated into contact with the lower-most article of sheet material 19. At this position in the profile, a vacuum is typically applied to suckers 21. Shortly thereafter, suckers 21 are deflected at a relatively uniform speed and attain the "down" position at a time interval corresponding to drum position D, for example, between about 20 and about 30 degrees beyond the zero reference position. Typically, when the suckers are in the "down" position, that is, displaced from the lower-most article of sheet material 19, the vacuum is turned off from suckers 21. As shown by curve 43, suckers 21 remain in the "down" position until the drum reaches orientation E, for example, at between about 320 degrees and about 330 degrees of drum 16 rotation. The suckers 21 are then raised at a relatively uniform velocity to the "up" position at about 360 degrees, or after one full rotation of drum 16. During this deflection of suckers 21 the vacuum is again applied to suckers 21. The position of sucker 21 then repeats this schedule.

The state of grippers 26, that is, "opened" or "closed", is represented by curve 44 in FIG. 5, again as a function of the rotation of drum 16. At a point corresponding to drum orientation A, grippers 26 are in the "opened" positioned. Grippers 26 remain opened until drum 26 reaches a position F, for example, between about 70 degrees and 80 degrees of drum 16 rotation, at which point grippers 26 begin to close. At point G, for example, between about 80 and about 90 degrees, grippers 26 are "closed". Grippers 26 then remain closed until drum 16 reaches a position H, for example, between about 215 degrees and about 225 degrees. Grippers 26 then partially open to an intermediate position to release an article of sheet material 24 before fully opening beginning at a point E in preparation for subsequent closing on the next article of sheet material. Again, as shown by curve 44; this gripper position profile is then repeated.

FIG. 5 also includes other reference information for the feeding and conveying system of the present invention. For example, point J is the position of the drum corresponding to the time when blade 30 of disk 22 (see FIG. 3) enters the stack 18, for example, at a position of between about 30 degrees and about 40 degrees. Note that at this point, J, per curve 41, disk 22 is rotating at is maximum speed; per curve 42, disk 22 is approximately midway in its deflection from its reference location; per curve 43, suckers 21 are closing; and per curve 44, grippers 26 are open. According to the present invention the reciprocating rotation of disk 22, and the corresponding operation of drum 16, suckers 21, and grippers 26 are synchronized. This synchronization can be practiced mechanically, for example, via cams and timing belts, or electro-mechanically, for example, via linkages operated by actuators that are controlled by electronics, for example, by digital control software. In one aspect of the invention, the speed and position of separator disk 22 is monitored and controlled by means of the servo-control system shown schematically in FIG. 6.

Figure 6:
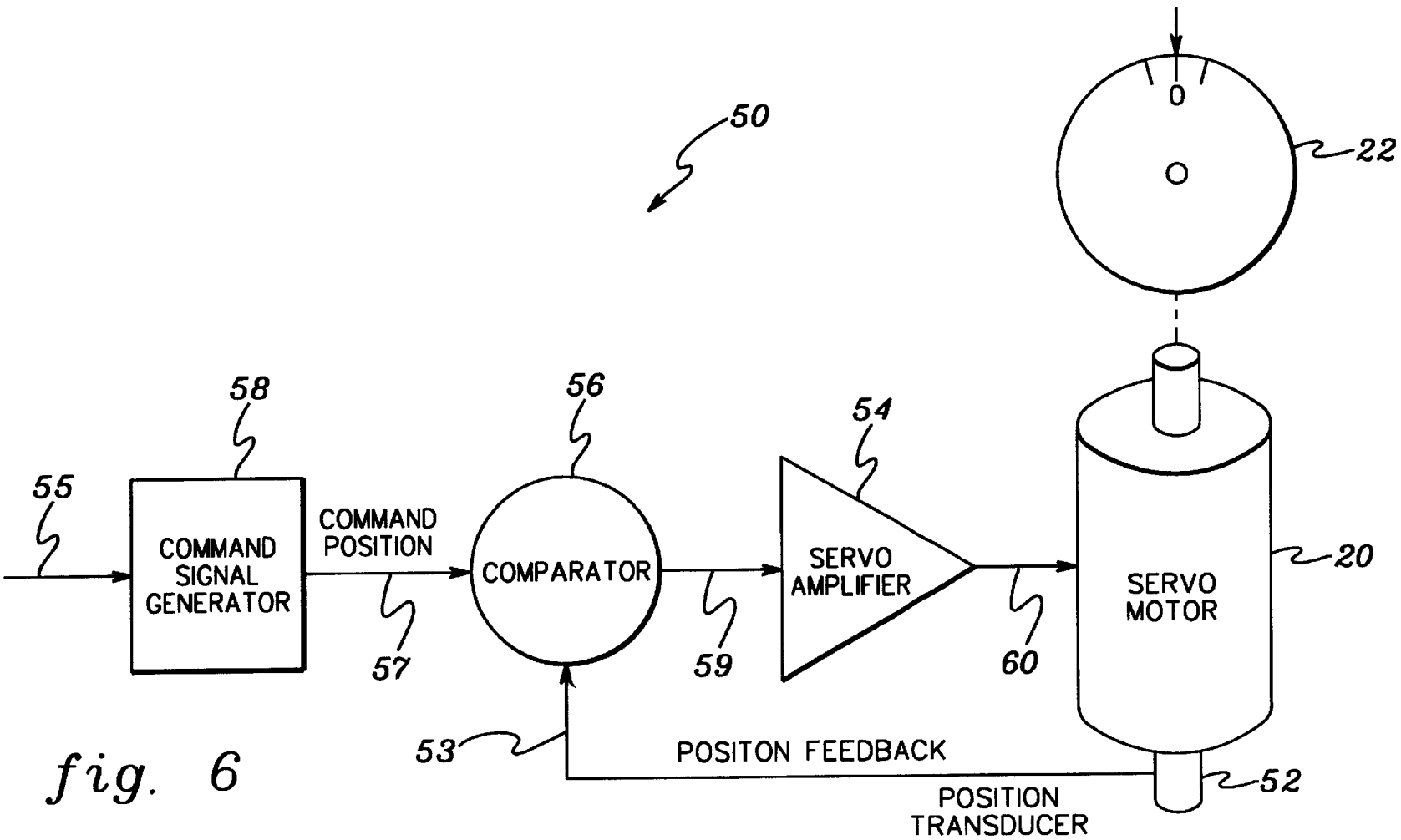
FIG. 6 is a schematic block diagram of a servo-control system which can be used to control the feeding and conveying system shown in FIG. 1 in accordance with one aspect of the present invention.

FIG. 6 illustrates a servo-control system generally designated with the reference numeral 50 that can be used to practice one aspect of the present invention. Servo-control system 50 includes a servomotor 20, a position transducer 52, a servo-amplifier 54, a comparator 56, and a command signal generator 58. Servo-control system 50 regulates and controls the operation of servomotor 20 to regulate and control the displacement, speed, and acceleration of separator disk 22. Servo-control system 50 is programmable, for example, command signal generator 58 may be programmable. Servo-control system 50 may be programmed to regulate and control the displacement, speed, or acceleration of disk 22 in order to optimize the operation of disk 22 and feeder 14. In one aspect of the invention, servo-control system 50 is programmed to regulate the displacement, velocity, and acceleration of disk 22 to the schedules shown in FIG. 5, though servo-control system 50 can be programmed for any displacement, velocity, or acceleration schedule desired. Servo-control system 50 may be manually operable at the feeder, may be controlled from a desktop computer, may be integrated into a network of control systems designed to optimize handling system throughput, or controlled by means of any conventional programmable device, for example, a computer or programmable logic controller (PLC). It will be apparent to those in the art that servo-control system 50 and servomotor 20 can be integrated with new feeder systems or be retrofit to existing feeders.

Servomotor 20 drives separator disk 22 in response to the control algorithm of control system 50. Position transducer 52 provides an indication of the position of separator disk 22. The position sensed by position transducer 22 is fed to comparator 56 via feed back loop 53. Command signal generator 58 receives a position indication from drum 16 via electrical connection 55 and transfers a command position to comparator 56 via electrical connection 57. Comparator 56, via an appropriate algorithm, compares the command position and the feed back position of disk 22 and generates and error signal that is forwarded to amplifier 54 via connection 59. Servo-amplifier 54 amplifies this error signal and provides an amplified error signal to servomotor 20 via connection 60 which increase or decreases the speed of disk 22 to eliminate the error and conform to the desired speed schedule for disk 22, for example, the schedule defined by curve 41 in FIG. 5. As a result, control system 50 coordinates the rotation of disk 22 with the rotation of drum 16, so that, among other things, grippers 26 (see FIG. 2) are open and ready to receive an article of sheet material separator disk 22 separates an article of sheet material 24 from the stack of sheet material 18.

Servomotor 20 is typically a variable speed servomotor that is mechanically coupled to and rotates separator disk 22. According to one aspect of the invention, servomotor 20 includes an absolute encoder coupled with comparator 56 to deliver the position of separator disk 22 to comparator 56. According to an alternate aspect of the invention, servomotor 20 includes an incremental encoder, or a resolver.

According to one aspect of the present invention, control system 50 controls the operation of servomotor 20 to effect a reciprocating rotation to separator disk 22. One such reciprocating rotation is shown by curve 41 in FIG. 5. This reciprocal rotation of disk 22 according to one aspect of the present invention provides an effective means of separating sheet material for feeding to, for example, a sheet-material-collating conveyor. Compared to prior art methods, this reciprocal separation, among other things, minimizes or eliminates misalignment of the sheet material in the magazine that can occur during non-reciprocating separation that characterizes the prior art.

While the invention has been particularly shown and described with reference to preferred embodiment, it will be understood by those skilled in the art that various changes in form and details may be made to the invention without departing from the spirit and scope of the invention described in the following claims.

What is claimed is:

1. A feeder for delivering articles of sheet material to a conveyer, comprising:

a rotatable separator disk for separating stacked articles of sheet material;

a motor operatively connected to the separator disk for rotating the separator disk;

a programmable control system for controlling the operation of the motor, the programmable control system comprising a command signal generator, a comparator, and an amplifier; and a rotatable feed drum oriented to receive the articles of sheet material separated by the separator disk and transfer the articles of sheet material to the conveyor.

2. The feeder as recited in claim 1, wherein the programmable control system is programmed to control at least the speed of rotation of the motor.

3. The feeder as recited in claim 1, wherein the programmable control system is programmed to operate the motor whereby the separator disk is reciprocatingly rotated.

4. The system as recited in claim 1, wherein reciprocatingly rotating comprises rotating the separator disk in a first direction and rotating the disk in a second direction, opposite the first direction.

5. The system as recited in claim 4, wherein rotating the disk in the second direction is practiced immediately after rotating the disk in the first direction.

6. The system as recited in claim 1, further comprising means for deflecting an edge of the article of sheet material.

7. The system as recited in claim 6, wherein the means for deflecting comprises at least one source of vacuum.

8. The feeder as recited in claim 1, further comprising at least one gripper mounted on the feed drum.

9. The feeder as recited in claim 1, wherein the at least one article of sheet material comprises one of sheets of paper, signatures, newsprint, magazines, inserts, onserts, flyers, and brochures.

10. The feeder as recited in claim 1, wherein the conveyor is one of a collating conveyor and a gathering conveyor.

11. The feeder as recited in claim 1, wherein the programmable control system operates the motor wherein the motor rotates the separator disk at a first rotational speed in a first direction and rotates the separator disk at a second rotational speed in a second direction, opposite the first direction.

12. The feeder as recited in claim 11, wherein the first rotational speed and the second rotational speed are about equal in magnitude.

13. The feeder as recited in claim 11, wherein the first rotational speed is between about 600 rpm and about 900 rpm.

14. The feeder as recited in claim 12, wherein the first rotational speed is between about 600 rpm and about 900 rpm.

* * * * *

UNITED STATES PATENT AND TRADEMARK OFFICE

CERTIFICATE OF CORRECTION

PATENT NO. : 6,623,000 B2
DATED : September 23, 2003
INVENTOR(S) : Hall et al.

It is certified that error appears in the above-identified patent and that said Letters Patent is hereby corrected as shown below:

Title page,
Item [75], Inventor, delete "David F. Hall, Plattsburgh, NY (US)" and insert
-- David F. Hall, Plattsburgh, NY (US)
John E. Prim, West Chazy, NY (US) --

Signed and Sealed this

Twenty-fifth Day of May, 2004

JON W. DUDAS
*Acting Director of the United States Patent and Trademark Office*